US006499676B1

(12) United States Patent
Erdogan

(10) Patent No.: US 6,499,676 B1
(45) Date of Patent: Dec. 31, 2002

(54) FUEL INJECTION VALVE FOR INTERNAL COMBUSTION ENGINES

(75) Inventor: Arif Erdogan, Besevler-Bursa (TR)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/582,726

(22) PCT Filed: Jun. 22, 1999

(86) PCT No.: PCT/DE99/01818

§ 371 (c)(1),
(2), (4) Date: Aug. 25, 2000

(87) PCT Pub. No.: WO00/26528

PCT Pub. Date: May 11, 2000

(51) Int. Cl.[7] ..... F02M 61/20

(52) U.S. Cl. ..... 239/533.9; 239/533.4; 123/472

(58) Field of Search ..... 239/533.1–533.12, 239/600, 85–95; 123/472, 470

(56) References Cited

U.S. PATENT DOCUMENTS 4,382,553 A * 5/1983 Thoma et al. ..... 239/533.9
4,715,541 A * 12/1987 Freudenschuss et al. . 239/533.4
4,715,542 A * 12/1987 Morell et al. ..... 239/533.9
4,962,890 A * 10/1990 Shindo et al. ..... 239/533.4
5,718,385 A * 2/1998 Fontell ..... 239/533.3
6,024,297 A * 2/2000 Greeves ..... 239/96
6,224,001 B1 * 5/2001 Cooke et al. ..... 239/533.12

* cited by examiner

*Primary Examiner*—Carl S. Miller
(74) *Attorney, Agent, or Firm*—Ronald E. Greigg

(57) ABSTRACT

A fuel injection valve for internal combustion engines, having a valve body that has a guide bore, in which a valve member is axially displaceably guided for controlling an injection cross section, and that is braced with its end face remote from the combustion chamber axially against a valve holding body via an intermediate disk, and a pressure chamber, formed by a cross-sectional enlargement of the guide bore, is provided in the valve body and can be filled with high fuel pressure via a pressure conduit that penetrates the valve body, the intermediate disk, and the valve holding body. The portion of the pressure conduit extending within the valve body is embodied as an oblique bore, which has an angle of inclination of between 15 and 35° to the longitudinal axis of the fuel injection valve.

9 Claims, 2 Drawing Sheets

FUEL INJECTION VALVE FOR INTERNAL COMBUSTION ENGINES

BACKGROUND OF THE INVENTION

1. Field of the Invention

The invention is directed to a fuel injection valve for internal combustion engines.

2. Description of the Prior Art

A fuel injection valve of the type with which this invention is concerned is known, for example, from German Patent Disclosure DE 195 08 636, which discloses a valve body which discharges with its free end into the combustion chamber of the engine to be supplied. The valve body has an axial blind bore, originating at its end face remote from the combustion chamber, that serves as a guide bore for a pistonlike valve member that is axially displaceably guided in this guide bore. On its lower end toward the combustion chamber, this valve member has a valve sealing face, with which it cooperates with a valve seat face formed on the closed end of the guide bore. Downstream of the sealing line between the valve sealing face and the valve seat face, an injection opening in the wall of the valve body is provided, which originating at the guide bore discharges into the combustion chamber of the engine to be supplied; the passage of fuel to this injection opening is controlled by the sealing cross section between the valve seat face and valve sealing face.

On its end remote from the combustion chamber, the valve body of the known fuel injection valve is braced axially against a valve holding body via a lock nut; an intermediate disk is fastened between the end faces, facing one another, of the valve body and of the valve holding body.

The known fuel injection valve also has a pressure chamber in the valve body; the pressure chamber is formed by a cross-sectional enlargement of the guide bore, and the valve member protrudes into it with a pressure shoulder pointing in the opening direction. This pressure chamber extends as far as the valve seat face and is filled with high fuel pressure via a pressure conduit. To that end, the pressure conduit protrudes through the valve body, the intermediate disk, and the valve holding body, and can be connected to a high-pressure fuel pump via an external high-pressure inlet line. The part of the pressure conduit extending in the valve body is embodied, beginning at the end face toward the intermediate disk, as an oblique bore and intersects the pressure chamber at its radially outward-pointing end.

The known fuel injection valve has the disadvantage that a nip region, formed in the valve body between the guide bore and the oblique bore, severely impairs the high-pressure resistance of the entire fuel injection valve. In order to make this nip region more resistant to high-pressure, especially at the level of the entrance orifice of the oblique bore into the pressure chamber, the annular shoulders of the valve holding body and of the lock nut in the known fuel injection valve are already embodied as beveled in such a way that the axial fastening forces on the fuel injection valve introduce a radially inward-oriented force component into the valve body, in order to counteract enlargement of the guide bore in the nip region. However, even this provision is inadequate to significantly increase the high- pressure resistance of the valve body in the region of intersection among the oblique bore, guide bore and pressure chamber, since the wall rib region that remains between the oblique bore of the pressure conduit and the guide bore is still very small, and thus there is still the risk of breakage at this point under very high fuel injection pressures.

SUMMARY OF THE INVENTION

The fuel injection valve for internal combustion engines according to the invention, has the advantage over the prior art that the wall rib region between the oblique bore of the pressure conduit and the guide bore can be increased in size considerably, particularly in the region of the inlet opening of the oblique bore into the pressure chamber, compared with conventional fuel injection valves. This is advantageously made possible by greatly increasing the angle of inclination of the oblique bore to a longitudinal axis of the fuel injection valve, so that the angle of intersection is made considerably larger. The angle between the axis of the oblique bore and the longitudinal axis of the fuel injection valve is advantageously between 15 and 35°, and is preferably 23°.

The very much more-oblique disposition of the oblique bore in the valve body advantageously first becomes possible by a great reduction in the length of the oblique bore. This shortening of the oblique bore is made possible according to the invention by the provision of an annular shoulder on the end of the valve body remote from the combustion chamber; the resultant annular shoulder face can now be brought axially close to the pressure chamber in the valve body, so that large angles of inclination between the axis of the oblique bore and the longitudinal axis of the fuel injection valve become possible. What would be ideal here is a virtually perpendicular entrance of the oblique bore into the pressure chamber; the inclination of the oblique bore can now be varied via the axial length between the pressure chamber and the annular shoulder face. In order, despite the shortest possible length of the oblique bore, to furnish the largest possible guide area of the guide bore in the valve body for guiding the valve member, the valve body, on its end remote from the combustion chamber, has a tubular rib region that protrudes axially past the annular shoulder face, and the guide area for the valve member can be optimized by way of the length of this tubular rib region. The intermediate disk, fastened between the valve body and the valve holding body, is now adapted to the new geometry of the valve body, and it has a geometry complimentary thereto on its end toward the valve body. To that end, the intermediate disk is now advantageously cup-shaped, and on its open end toward the valve body it has a central receiving opening, into which the tubular rib region of the valve body protrudes. The intermediate disk is designed in such a way that the valve body comes to rest sealingly with its annular shoulder face on an axially protruding annular end face of the intermediate disk, yet a play remains between the end of the tubular rib and the end face on the bottom of the receiving opening. In this way, a secure sealing of the pressure conduit is assured at the connecting faces between the intermediate disk and the valve body and between the intermediate disk and valve holding body. Furthermore, it is possible to compensate for play in the length tolerances between the various components.

A further advantage of the fuel injection valve of the invention is achieved by increasing the diameter of the pressure conduit downstream toward the pressure chamber. The successive diameter regions in the valve holding body, intermediate disk and valve body each have a slightly larger diameter, so that the incoming fuel flow cannot be made turbulent by edges or cross-sectional reductions at the transitions between the various components.

BRIEF DESCRIPTION OF THE DRAWINGS

Further advantages and advantageous features of the invention can be learned from the detailed description contained herein below, taken with the drawings, in which.

DESCRIPTION OF THE PREFERRED EMBODIMENT

Figure 1:
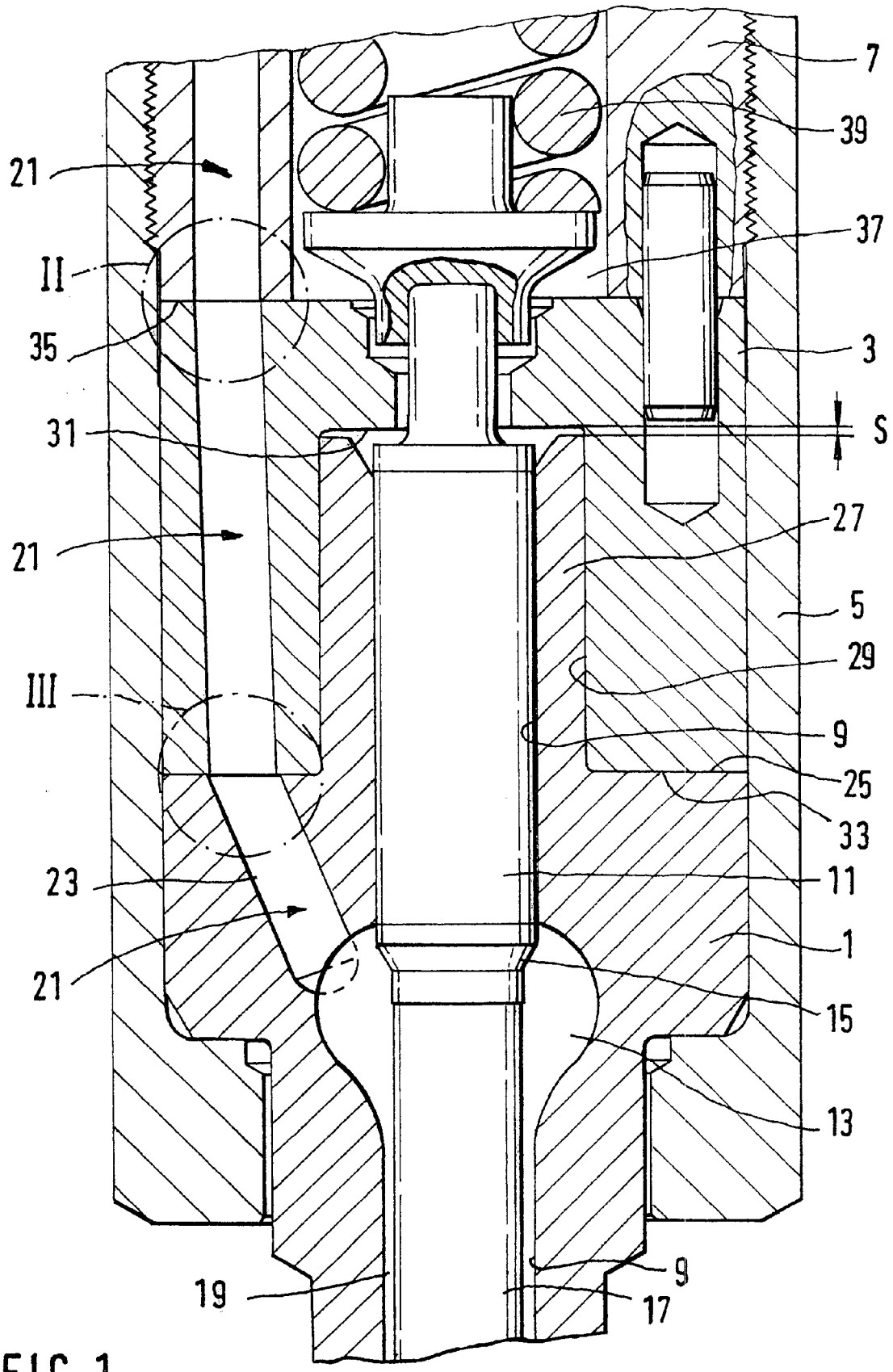
FIG. 1 shows a section through the part of the fuel injection valve that is essential to the invention, in the bracing region between the valve body and the valve holding body.

The exemplary embodiment of the fuel injection valve of the invention for internal combustion engines, which is shown in its portion essential to the invention in FIG. 1, has a valve body 1, which with the interposition of an intermediate disk 3 is braced by a sleevelike lock nut 5 axially on a valve holding body 7. The valve body 1 has an axial guide bore 9, in which a pistonlike valve member 11 is guided axially displaceably. Analogously to known fuel injection valves, on its lower end toward the combustion chamber, this valve member 11 has a conical valve sealing face, not shown with which, to control an injection opening cross section, it cooperates in known manner with a stationary valve seat face, also not shown, on the valve body. This also conical valve seat face is embodied on the closed end of the guide bore 9, and downstream of the sealing cross section between the valve seat face and the valve sealing face, an injection opening leads in a known manner away from the guide bore 9, which discharges into the combustion chamber of the engine to be supplied.

Also provided in the valve body 1 is a pressure chamber 13, which is formed by a cross-sectional enlargement of the guide bore 9. An oblique shoulder 15, formed on the valve member 11, protrudes into this pressure chamber 13; this shoulder is formed by a cross-sectional reduction of the valve member 11 in the direction of the combustion chamber, and a high fuel pressure prevailing in the pressure chamber 13 engages this shoulder in the opening direction of the valve member 11. Between the reduced-cross section valve member shaft 17 and the wall of the guide bore 9, an annular gap 19 is formed, which extends as far as the valve seat, not shown in detail, of the fuel injection valve. The filling of the pressure chamber 13 with fuel at high pressure is effected via a pressure conduit 21, which penetrates the valve body 1, intermediate disk 3 and valve holding body 7, and which in a manner not shown in detail can be connected to an external high-pressure fuel delivery line that originates at a high-pressure fuel pump. In the region of the valve body 1, the pressure conduit 21 is embodied as an oblique bore 23, which has an angle of inclination a of about 23° relative to a longitudinal axis of the fuel injection valve. In the flow direction, the oblique bore 23 is inclined radially inward, and it discharges into a radially outward- pointing wall region of the pressure chamber 13. The portion of the pressure conduit 21 extending in the intermediate disk 3 is also provided in a radially outer region of the intermediate disk 3 and furthermore also has a small angle of inclination $\beta$ of about 1.5° radially inward in terms of the flow direction.

For the sake of the greatest possible inclination of the oblique bore 23 inside the valve body 1, the valve body has an annular shoulder 25, which is formed by a cross-sectional reduction of the valve body 1 on its end remote from the combustion chamber, a tubular rib region 27 that remains protrudes axially past the resultant annular shoulder face 25. The entrance opening of the oblique bore 23 is now provided in the annular shoulder face 25, and the maximum possible angle of inclination $\alpha$ of the oblique bore 23 can be varied by way of the design of the annular shoulder 25 and the spacing between the annular shoulder face 25 and the pressure chamber 13. The intermediate disk 3 fastened between the valve body 1 and the valve holding body 7, on its side toward the valve body 1, has a cuplike shape that is complimentary to the geometry of the valve body. To that end, a receiving opening 29 is made in the open side, toward the valve body, of the cup-shaped intermediate disk 3, and the tubular rib region 27 of the valve body 1 protrudes into this receiving opening. A play S is provided between the annular end face of the tubular rib 27 and a face 31 formed on the bottom 31 of the cup-shaped end face of the intermediate disk 3; by way of this play, it is possible to compensate for play between the valve body 1 and the intermediate disk 3. The sealing between the intermediate disk 3 and the valve body 1 and in particular between the pressure conduit portions 21 in the valve body 1 and the intermediate disk 3, is effected via the sealing contact of an annular end face 33, which radially surrounds the receiving opening 29, on the end toward the valve body of the intermediate disk 3, with the annular shoulder face 25 of the valve body 1. On its end toward the valve holding body 7, the intermediate disk 3 rests sealingly in a known manner on the valve holding body 7; the valve holding body has a blind bore, which originates at its end face 35 toward the intermediate disk 3 which is formed a spring chamber 37 for receiving a valve spring 39 that urges the valve member 11 in the closing direction.

Figure 2:
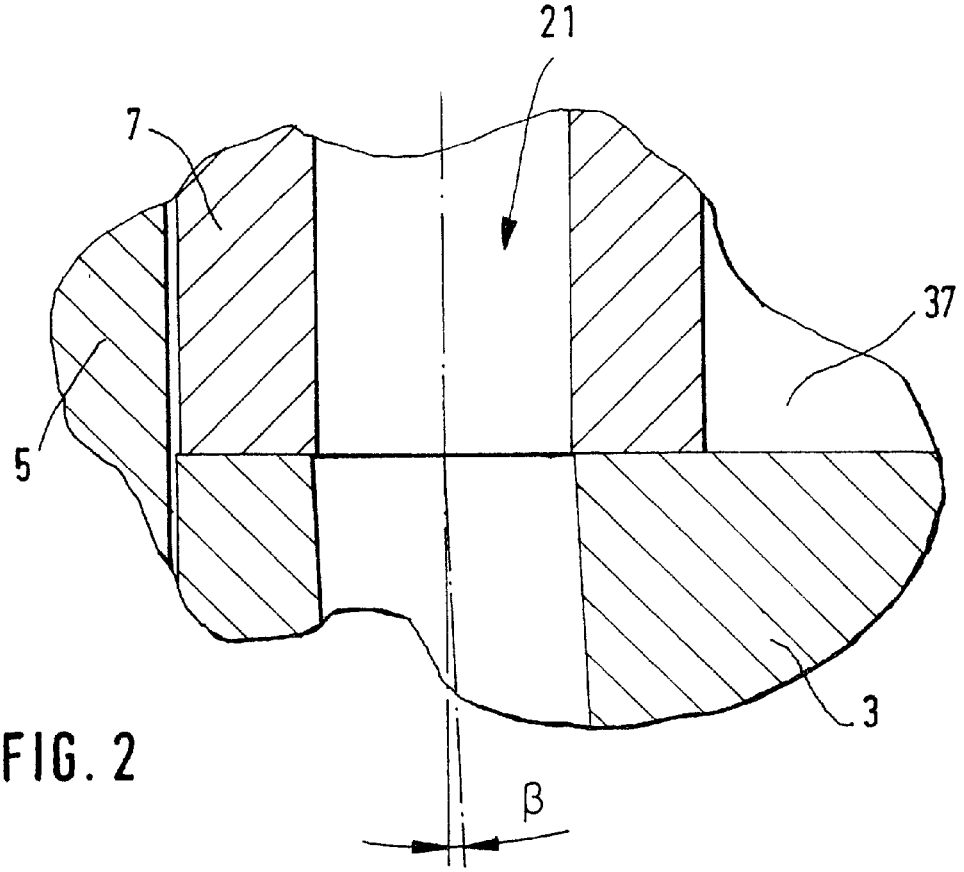
FIGS. 2 and 3 are enlarged fragmentary views of the structure shown in detail of FIG. 1 in the region of the pressure conduit transitions between the various components.

To avoid turbulence inside the pressure conduit 21 of the fuel flowing into the pressure chamber 13, the diameters of the successive downstream pressure conduit regions are each increased slightly relative to one another. The pressure conduit 21, as shown in FIG. 2, initially has a slightly smaller diameter in the region of the valve holding body 7 than in the portion located inside the intermediate disk 3.

Figure 3:
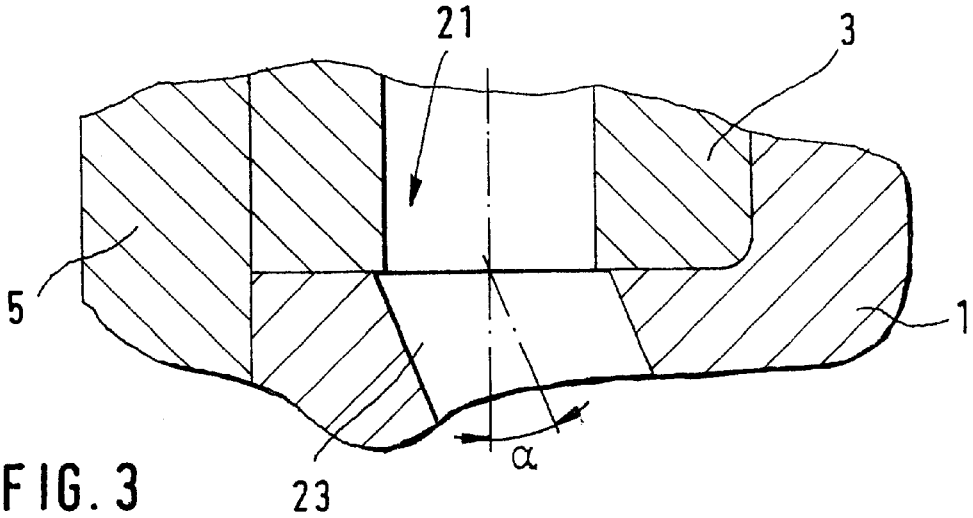

In addition, the diameter of the pressure conduit 21 increases once again, as shown in FIG. 3, at the transition between the portion located inside the intermediate disk 3 and the oblique bore 23 inside the valve body 1. The variations in diameter are preferably in a range of about 0.05 mm.

The embodiment of the fuel injection valve of the invention now makes it possible to dispose the pressure conduit 21, which when fully functional enables an enlargement of the remaining wall rib region between the oblique bore 21 and the guide bore 9, especially in the region near the pressure chamber, such that the high-pressure resistance of the valve body 1 in this critical region can be increased such that even fuel injection pressures above 1800 bar are possible without additional provisions. This increase in the high-pressure resistance can be combined with other known provisions, such as oblique shoulders on the valve body 1 and on the lock nut 5, and increased still further. Thus with the fuel injection valve of the invention, it is possible to operate the fuel injection valve even at very high fuel injection pressures, without having to increase the dimensioning or the outside dimensions for the sake of high durability.

The foregoing relates to preferred exemplary embodiments of the invention, it being understood that other variants and embodiments thereof are possible within the spirit and scope of the invention, the latter being defined by the appended claims.

I claim:

1. In a fuel injection valve for internal combustion engines, having a valve body (1) that has a guide bore (9), in which a valve member (11) is axially displaceably guided for controlling an injection cross section, and that is braced with its end face remote from the combustion chamber axially against a valve holding body (7) via an intermediate disk (3), and a pressure chamber (13), formed by a cross-sectional enlargement of the guide bore (9), is provided in the valve body (1) and can be filled with high fuel pressure via a pressure conduit (21) that penetrates the valve body (1), the intermediate disk (3), and the valve holding body (7), wherein the improvement comprises the portion of the pressure conduit (21) extending within the valve body (1) is embodied as an oblique bore (23) which has an angle of inclination of between 15 and 35 degrees to the longitudinal axis of the fuel injection valve, with the valve body (1), on its end remote from the combustion chamber, having an annular shoulder formed by a diameter reduction, from whose annular shoulder face (25), toward the intermediate disk (3), the oblique bore (23) is slanted towards the pressure chamber (13).

2. The fuel injection valve of claim 1, wherein the intermediate disk (3), on its end toward the valve body (1), has a cuplike shape that is complimentary to the geometry of the end remote from the combustion chamber of the valve body (1), and the intermediate disk (3), on its open end toward the valve body has a receiving opening (29), into which a tubular ridge region (27) of the valve body (1), of reduced diameter, protrudes axially past the annular shoulder face (25).

3. The fuel injection valve of claim 2, wherein the intermediate disk (3), with an annular end face (33) toward the valve body (1) and radially outwardly surrounding the receiving opening (29), rests sealingly on the annular shoulder face (25) of the valve body (1).

4. The fuel injection valve of claim 2, wherein a play (S) is provided between an end face formed on the bottom (31) of the cup-shaped intermediate disk (3), and an annular end face formed on the end of the tubular ridge region (27) of the valve body (1).

5. The fuel injection valve of claim 1, wherein the diameter of the portion of the pressure conduit (21) extending in the valve holding body (7) is smaller than the diameter of the adjacent downstream portion of the pressure conduit (2) in the intermediate disk (3).

6. The fuel injection valve of claim 1, wherein the diameter of the portion of the pressure conduit (21) extending in the intermediate disk (3) is smaller than the diameter of the adjacent downstream portion, embodied as an oblique bore (23), of the pressure conduit (21) in the valve body (1).

7. The fuel injection valve of claim 1, wherein a bore in the intermediate disk (3) that forms a part of the pressure conduit (21) and begins at an end face toward the valve holding body (7) is disposed radially inclined inward relative to an end face toward the valve body (1), and the angle β between the axis of this bore and a longitudinal axis of the fuel injection valve is preferably about 1.5°.

8. In a fuel injection valve for internal combustion engines, having a valve body (1) that has a guide bore (9), in which a valve member (11) is axially displaceably guided for controlling an injection cross section, and that is braced with its end face remote from the combustion chamber axially against a valve holding body (7) via a cup shaped intermediate disk (3), and a pressure chamber (13), formed by a cross-sectional enlargement of the guide bore (9), is provided in the valve body (1) and can be filled with high fuel pressure via a pressure conduit (21) that penetrates the valve body (1), the cup shaped intermediate disk (3), and the valve holding body (7), wherein the improvement comprises the valve body (1) on its end remote from the combustion chamber has a centrally extending tubular ridge (27) confined within the cup shaped intermediate disk (3) and extending along the annular shoulder face (25), the free end of the tubular ridge (27) defining a space (S) located adjacent the intermediate disk (3), with a sleeve-like lock nut (5) firmly engaging the valve body (1), the intermediate disk (3) and adjustably secured to the valve holding body (7), thereby functioning as an axial restraint of space (S) with controllable adjustability.

9. In a fuel injection valve for internal combustion engines, having a valve body (1), which valve body has a guide bore (9) in which a valve member (11) is axially displaceably guided for controlling an injection cross section, and which valve body (1) has a surface (25) remote from the combustion chamber which is braced axially against a valve holding body (7) via an intermediate disk (3), and a pressure chamber (13), formed by a cross-sectional enlargement of the guide bore (9), is provided in the valve body (1), which pressure chamber (13) can be filled with fuel having a high fuel pressure via a pressure conduit (21)that penetrates the valve body (1), the intermediate disk (3), and the valve holding body (7), the improvement wherein the valve body (1), on its end remote from the combustion chamber has a predetermined diameter, and has a reduced diameter tubular ridge region (27) which has an end surface, and the remainder of the valve body (1) includes said surface (25) which the intermediate disk (3) engages, whereby the intermediate disk (3) is spaced apart from the end surface of the tubular ridge region (27), wherein the surface (25) of the valve body (1) which engages the intermediate disk (3) has substantially less area than the area of a surface of a circle having the predetermined diameter, so that less contact force between the intermediate disk (3) and the valve body (1) is necessary to obtain an effective seal around the pressure conduit (21).

* * * * *

UNITED STATES PATENT AND TRADEMARK OFFICE

CERTIFICATE OF CORRECTION

PATENT NO. : 6,499,676 B1
DATED : December 31, 2002
INVENTOR(S) : Arif Erdogan

It is certified that error appears in the above-identified patent and that said Letters Patent is hereby corrected as shown below:

Title page,
Item [30], Foreign Application Priority Data, should read as follows:

-- [30] Foreign Application Priority Data:
November 02, 1998 (DE) …… 1 98 50 387 --

Signed and Sealed this

Eighth Day of April, 2003

JAMES E. ROGAN
*Director of the United States Patent and Trademark Office*